US005257601A

United States Patent [19]

Coffin

[11] Patent Number: 5,257,601

[45] Date of Patent: Nov. 2, 1993

[54] ADJUSTABLE ROTARY VALVE ASSEMBLY FOR A COMBUSTION ENGINE

[76] Inventor: David F. Coffin, 8430 Truxton Ave., Los Angeles, Calif. 90045

[21] Appl. No.: 11,689

[22] Filed: Feb. 1, 1993

[51] Int. Cl.[5] ..... F02B 33/04

[52] U.S. Cl. ..... 123/73 D; 123/73 V; 123/190.14

[58] Field of Search ..... 123/190.1, 190.3, 190.14, 123/190.2, 80 D, 73 D, 73 V, 65 V

[56] References Cited

U.S. PATENT DOCUMENTS

| | | | |
|---|---|---|---|
| 1,009,945 | 11/1911 | Veitch | 123/73 D |
| 3,822,682 | 7/1974 | Sherwood | 123/190.14 |
| 4,071,000 | 1/1978 | Herbert | 123/73 D |
| 4,418,658 | 12/1983 | DiRoss | 123/190.14 |
| 4,550,696 | 11/1985 | Ehrlich | 123/80 D |
| 4,838,220 | 6/1989 | Parsons | 123/190.14 |

*Primary Examiner*—E. Rollins Cross
*Assistant Examiner*—Erick Solis
*Attorney, Agent, or Firm*—Kelly Bauersfeld & Lowry

[57] ABSTRACT

A rotary valve assembly is provided for use in a combination engine, wherein the valve assembly is adjustable for variable valve timing during engine operation. The rotary valve assembly comprises a rotary valve plate formed by a pair of valve leaves mounted coaxially in overlapping relation and defining an open arcuate valve port. The valve plate is rotatably mounted to extend across and thereby open and close an engine valve passage, such as an intake passage in a two-stroke combustion engine. An adjustment sleeve is provided to rotate the valve leaves during engine operation to rotate the valve leaves during engine operation in response to one or more selected engine operating conditions, to correspondingly and selectively adjust the engine valve timing.

19 Claims, 3 Drawing Sheets

FIG. 2
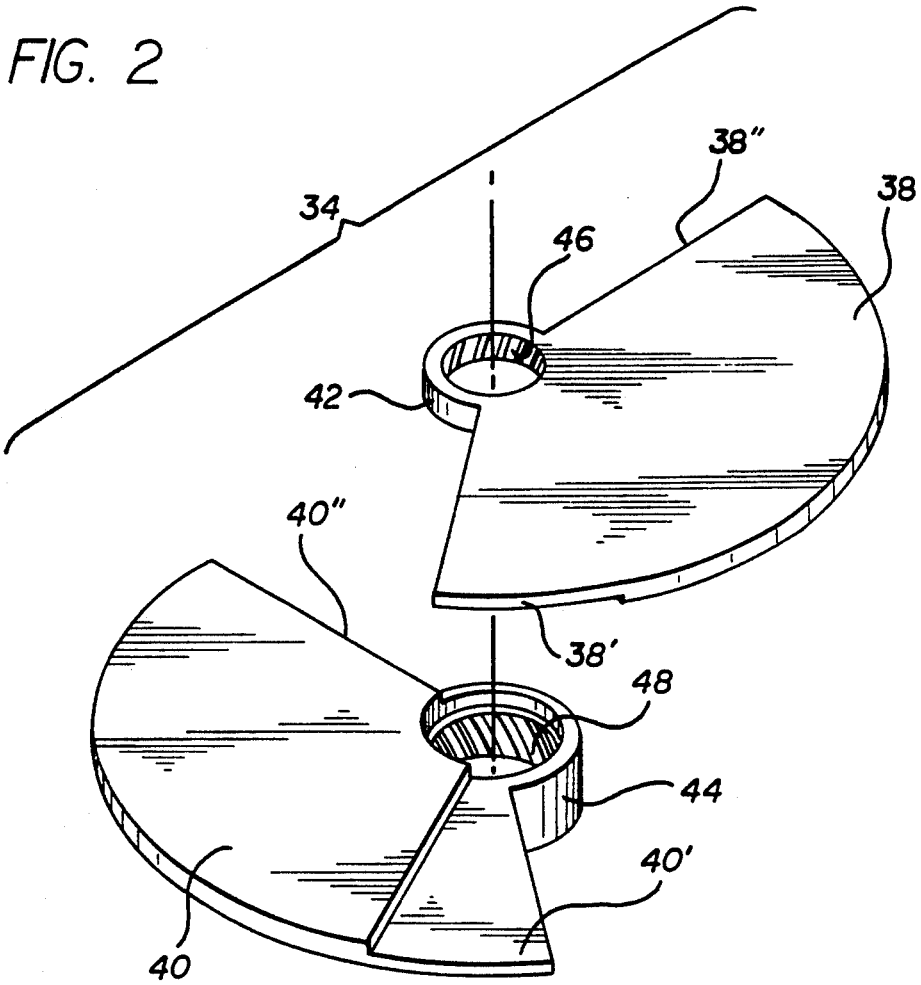
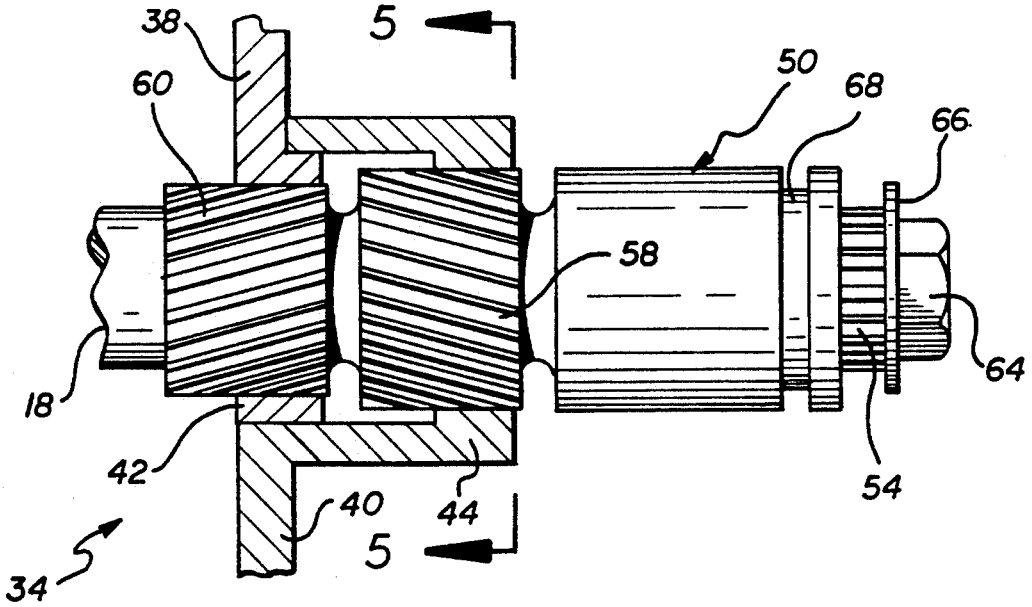
FIG. 4

FIG. 5
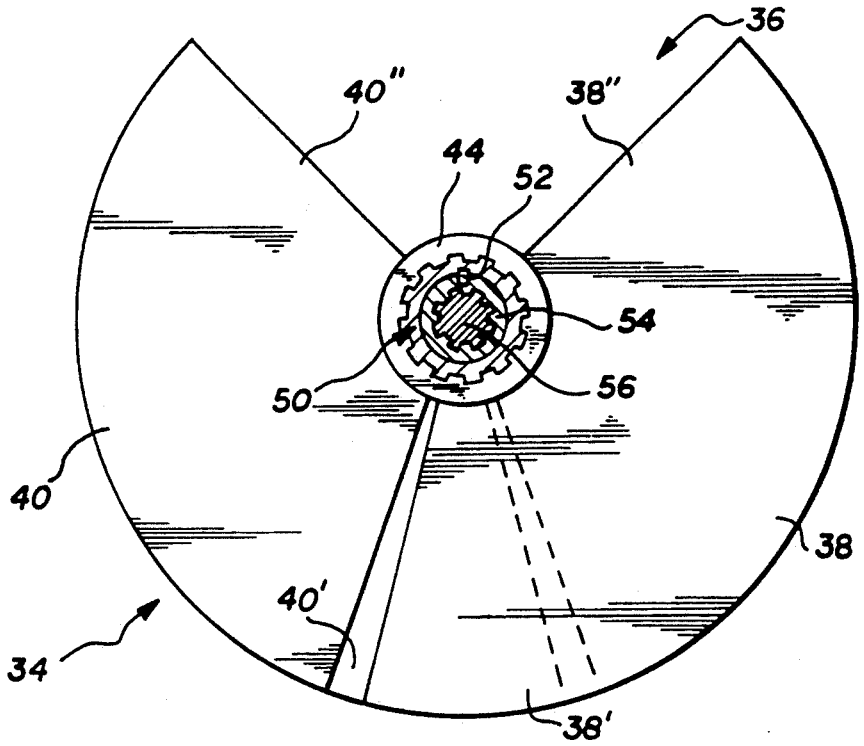
FIG. 6
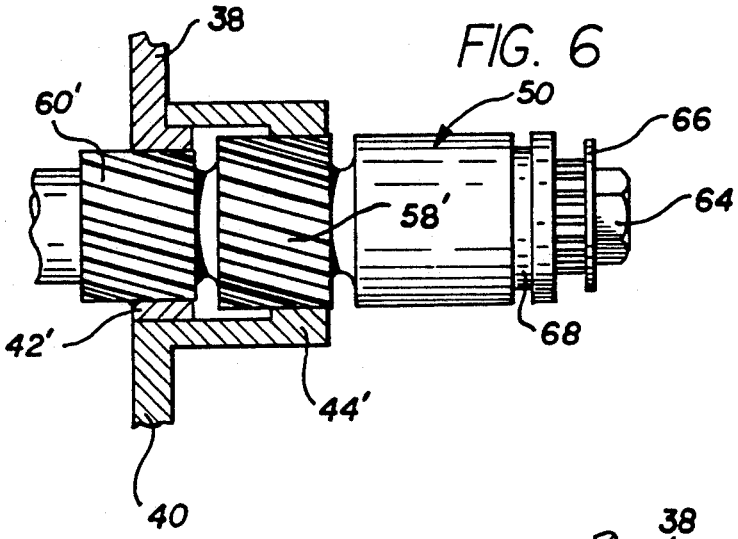
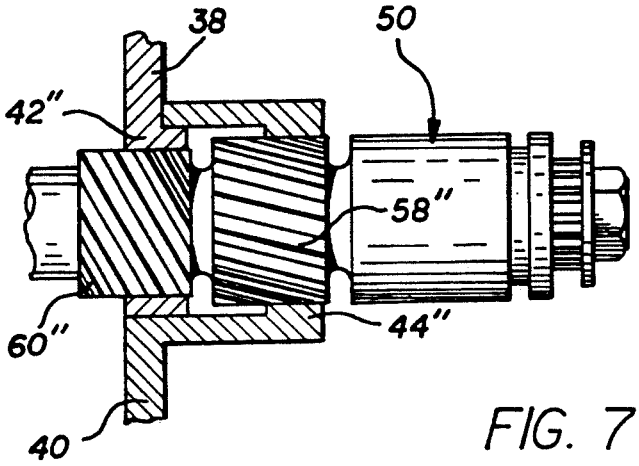
FIG. 7

ADJUSTABLE ROTARY VALVE ASSEMBLY FOR A COMBUSTION ENGINE

BACKGROUND OF THE INVENTION

This invention relates generally to rotary valve assemblies of the type used in a reciprocating combustion engine to regulate flow of gasses through engine valve passages. More particularly, this invention relates to an improved rotary valve assembly designed for variable valve timing during engine operation, in response to different engine operating conditions.

Reciprocating combustion engine are well known in the art to include one or more pistons mounted on a rotating crankshaft for reciprocal displacement within one or more combustion cylinders. Reciprocal movement of the piston within each cylinder is accompanied by a timed sequence delivery of a gaseous fuel-air mixture to the cylinder via an intake passage, and subsequent discharge of combustion products from the cylinder through an exhaust passage. Intake and exhaust valves are provided to open and close the intake and exhaust passages in precision coordination with piston movement.

In the past, intake and exhaust valves for internal combustion engines have been provided in different forms. As one example, piston-type poppet valves are used extensively in a wide variety of combustion engines, wherein spring-loaded valves are mechanically linked to the engine crankshaft for timed displacement to open and close the associated engine valve passages. Rotary valve plates having open arcuate valve ports have also been used, wherein the rotary valve plates are also linked mechanically to the engine crankshaft for coordinated displacement in relation to piston reciprocation within the associated cylinder. In some engines, particularly such as two-stroke engines, reed-type valves responsive to pressure fluctuations within the crankcase have been used. In most valve designs, adjustment of valve timing during normal engine operation, and in response to different selected engine operating conditions, has either not been possible or has otherwise required complex and costly valve mechanisms and related timing control systems.

In some combustion engines, variable valve timing can be extremely desirable for purposes of optimizing engine power output and minimizing toxic emissions over a broad range of engine operating conditions. For example, small two-stroke combustion engines are used in a wide variety of relatively low power applications, such as in motorcycles and scooters and in lawn and garden implements such as mowers, trimmers, blowers, mulchers, and the like. Such combustion engines are typically designed with relatively simple and thus inexpensive intake and exhaust valve mechanisms aimed at providing a desired balance of power output and emissions characteristics. However, variable valve timing in such engines, particularly intake valve timing as a function of engine speed and/or load, has been generally impractical and in most instances not possible. As a result, small combustion engines of this type are normally designed for relatively efficient operation with a narrow range of engine speed and/or load. Unfortunately, when the engine is operated outside this narrow design range, relatively inefficient engine performance and/or a substantial increase in undesired emissions tends to result.

There exists, therefore, a significant need for improvements in valve assemblies used with combustion engines, particularly with respect to a relatively simple valve mechanism adapted for adjustable valve timing during engine operation in relation to selected engine characteristics such as speed and/or load. The present invention fulfills these needs and provides further related advantages.

SUMMARY OF THE INVENTION

In accordance with the invention, an improved rotary valve assembly is provided for use with a combustion engine for variably adjusting the engine valve timing in a predetermined manner during engine operation. The valve assembly comprises a rotary valve plate defined by a pair of coaxially mounted valve leaves which cooperatively define an open arcuate valve port. An adjustment mechanism is provided for rotatably displacing the valve leaves during engine operation, and in response to changes in one or more engine operating parameters to correspondingly adjust valve timing. In a preferred form, the valve leaves are rotatably displaced with respect to each other to increase or decrease the arcuate width of the open valve port in response to engine parameter changes.

In the preferred form of the invention, the valve plate is mounted to rotate across an open valve passage of an internal combustion engine, particularly such as a fuel-air intake passage leading to a combustion cylinder of a two-stroke engine. The valve plate is rotatably driven by the engine crankshaft, thereby providing coordinated displacement of the valve plate in timed relation to reciprocation of a piston within the combustion cylinder.

As the open valve port is rotated across the intake passage, a fuel-air mixture can be drawn into the cylinder for combustion. The crankshaft rotatably drives an adjustment sleeve mounted thereon for axial displacement through a short stroke. The adjustment sleeve in turn includes a pair of helical spline segments formed thereon in respective engagement with a pair of splined hubs carrying the two valve leaves. With this construction, axial displacement of the adjustment sleeve results in relative rotation of the splined hubs thereby displacing the valve leaves to correspondingly change the valve timing.

In the preferred form, the spline segments are formed in opposite-handed directions and mesh with the splined hubs, whereby axial adjustment sleeve motion rotates the splined hubs in opposite directions to increase or decrease the open arcuate width of the valve port in accordance with the direction of axial adjustment sleeve displacement. In alternative forms, the spline segments may be formed in a common-handed direction with uniform pitch to rotationally adjust the valve port relative to the crankshaft, or with non-uniform pitch to achieve rotational and arcuate width adjustment of the valve port. In each embodiment, the adjustment sleeve is axially displaced by an adjustment yoke in proportion to changes in one or more parameters, such as speed and/or load.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 2 is an exploded perspective view illustrating assembly of a pair of valve leaves to cooperatively define an adjustable rotary valve plate;

FIG. 4 is an enlarged fragmented sectional view illustrating adjustment of the assembled valve leaves to obtain variable valve timing during normal engine operation;

FIG. 5 is a sectional view taken generally on the line 5—5 of FIG. 4;

FIG. 6 is a fragmented sectional view similar to FIG. 4, but illustrating one alternative preferred embodiment of the invention; and FIG. 7 is a fragmented sectional view similar to FIGS. 4 and 6, but depicting a further alternative preferred form of the invention.

DETAILED DESCRIPTION OF THE PREFERRED EMBODIMENTS

Figure 1:
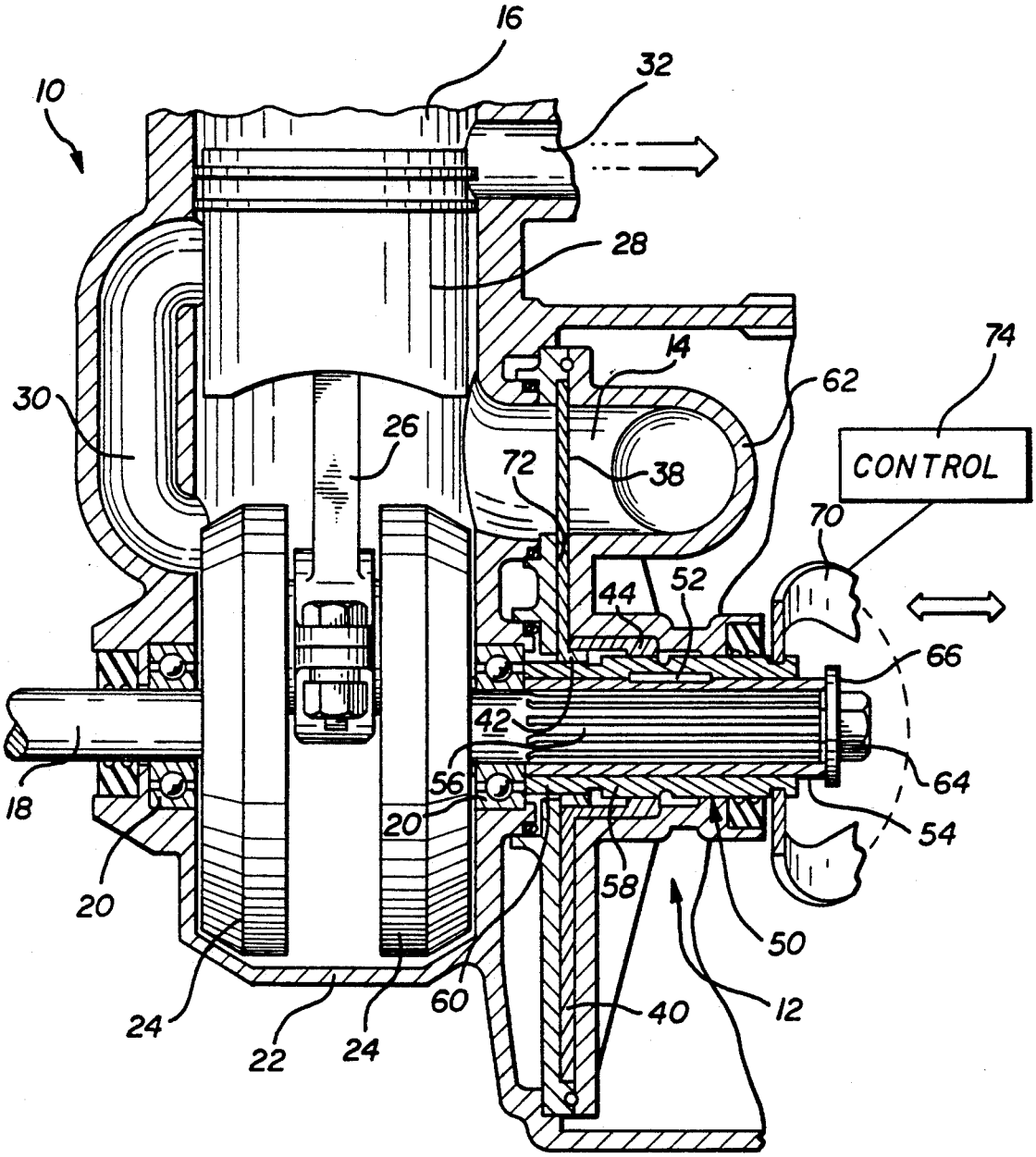
FIG. 1 is a fragmented and somewhat schematic vertical sectional view illustrating a combustion engine having an adjustable rotary valve assembly embodying the novel features of the invention.

As shown in the exemplary drawings, a combustion engine referred to generally by the reference numeral 10 includes an improved and adjustable rotary valve assembly 12. The rotary valve assembly 12 is shown in FIG. 1 for controlling inflow of a gaseous air-fuel mixture along an engine inlet passage 14 leading to a combustion cylinder 16. The rotary valve assembly 12 provides adjustable means for obtaining variable valve timing during normal engine operation.

The rotary valve assembly 12 is shown in FIG. 1 for use in a small two-stoke combustion engine of the type used, for example, in motorcycles and other small power-driven implements such as lawn and garden tools and the like. The illustrative two-stroke engine includes a crankshaft 18 supported by bearings 20 within a crankcase 22. The crankshaft 18 typically carries one or more flywheel weights 24 shown in FIG. 1 to be connected in turn by a piston rod 26 to a piston 28 mounted within the combustion cylinder 16. As is known in the art, reciprocal displacement of the piston 28 in response to rotation of the crankshaft 18 draws the air-fuel mixture through a transition passage 30 into the cylinder 16 for combustion, with the combustion products being subsequently exhausted from the cylinder 16 through an exhaust passage 32. The inlet passage 14, in accordance with operation of the rotary valve assembly 12, permits inflow of the gaseous air-fuel mixture into the crankcase 22 at the backside of the piston 28, for subsequent delivery through the transition passage 30 to the cylinder 16.

In general terms, the rotary valve assembly 12 comprises a rotary valve plate 34 driven by the crankshaft 18 to open and close the inlet passage 14 in timed relation to piston reciprocation. More specifically, the valve plate 34 is mounted to extend across and thus have the capability to close the inlet passage 14, as viewed in FIG. 1. The valve plate 34 is formed to include an open arcuate valve port or segment 36 (FIG. 5) which thus opens the inlet passage 14 each time the valve plate 34 is rotated for alignment of the open port 36 with the inlet passage. In accordance with the invention, the arcuate width of this open valve port 36 is adjustable during normal engine operation to permit adjustment of the valve timing.

Figure 3:
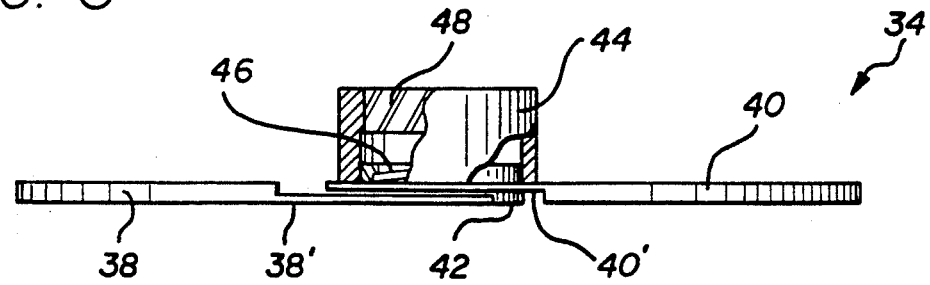
FIG. 3 is an edge elevation view illustrating the assembled valve leaves of FIG. 2.

More specifically, as shown best in FIGS. 2 and 3, the valve plate 34 comprises an assembled pair of radially extending valve leaves 38 and 40, each projecting radially outwardly from a corresponding cylindrical hub 42 and 44. Each of the valve leaves 38 and 40 has an arcuate dimension somewhat less than 180°, such as a dimension of about 150°, and includes an arcuate trailing edge segment 38', 40' of half-thickness for mated axial overlapping with the corresponding half-thickness segment on the other valve leaf. The central hubs 42, 44 are configured for coaxial and rotatable nested assembly, as shown in FIG. 2, thereby permitting relative coaxial rotation of the valve leaves 38, 40 with respect to each other. Leading edges 38", 40" of the two valve leaves 38, 40 define the opposite margins of the valve port 36, wherein valve timing is a direct function of the angular separation between these leading edges, and the rotational orientation of the open valve port relative to crankshaft rotation. The two hubs 42, 44 respectively include inner diameter surfaces defined by helical splines 46 and 48. In the embodiment shown in FIGS. 1-5, in accordance with one preferred form of the invention, these splines 46, 48 are formed in opposite-handed directions.

The assembled valve leaves 38, 40 defining the rotary valve plate 34 are mounted on the engine 10 with their coaxially nested hubs 42, 44 carried about an adjustment sleeve 50. As shown in FIGS. 1 and 4, the adjustment sleeve 50 comprises an elongated cylindrical member which is internally secured by a key or straight spline 52 for coaxial rotation with a support sleeve 54 connected in turn by an axial spline connection with a splined segment 56 on the crankshaft 18. The adjustment sleeve 50 is adapted for axial displacement through a short stroke on the support sleeve 54 and crankshaft 18. Importantly, the adjustment sleeve includes a pair of helically splined segments or lands 58 and 60 having helical male splines formed thereon for respective meshed engagement with the splines 46, 48 on the leaf hubs 42, 44. In the illustrative embodiment shown in FIGS. 1-5, the splined lands 58, 60 are thus formed in opposite-handed directions, whereby axial displacement of the adjustment sleeve 50 is accompanied by relative rotation of the valve leaves 38, 40 in opposite directions, for purposes of increasing and decreasing the width of the open valve port 36.

In the illustrative preferred form of the invention, the splined segment 56 of the crankshaft 18 projects through a wall of the crankcase 22 into a cylindrical cavity of a valve cover 62. The splined support sleeve 54 is retained on the crankshaft, as by means of a bolt 64 and washer 66 (FIG. 1). The adjustment sleeve 50 is mounted in turn on the support sleeve 54, with an outboard end of the adjustment sleeve defining a circumferential groove 68 in a position exposed to receive a control yoke 70 or the like. The control yoke 70 thus provides a mechanical linkage for displacing the adjustment sleeve 50 back and forth between stops defined respectively by the outboard crankshaft bearing 20 and the washer 66. The valve plate 34 fits into a disk-shaped cavity 72 in close-fitting running clearance between the crankcase 22 and the valve cover 62. The inlet passage 14 is defined cooperatively by aligned openings in the valve cover 62 and the crankcase housing.

During normal engine operation, the valve plate 34 is rotatably driven by the crankshaft 18 to displace the valve port 36 across the inlet passage 14 in timed relation with reciprocation of the piston 28 within the combustion cylinder 16. The specific valve timing for inflow of the air-fuel mixture to the engine is a function of the rotational position of the valve port 36 relative to crankshaft rotation and piston, as well as the arcuate width of the valve port 36. In response to different engine operating conditions, the adjustment sleeve 50 can be axially translated along the crankshaft 18 to correspondingly increase or decrease the arcuate span of the valve port 36, thereby altering engine valve timing. For example, the illustrative control yoke 70 can be linked mechanically to any suitable control 74 (FIG. 1) responsive to engine speed and/or load, such as by connection to a hand-operated throttle. In many instances, the control 74 will be operated to displace the adjustment sleeve 50 in a manner rotating the valve leaves 38, 40 to increase the arcuate span of the valve port 36 in response to speed increase, and vice versa.

FIGS. 6 and 7 respectively illustrate two additional alternative preferred forms of the invention, wherein engine valve timing is adjustable during engine operation as a function of changing engine parameters. For ease of description, structural componets depicted in FIGS. 6 and 7 which correspond with the embodiment of FIGS. 1-5 will be referred to by the same reference numerals.

FIG. 6 shows the rotary valve plate 34 to include the radial valve leaves 38 and 40, each projecting from the associated splined and coaxially mounted hub 42' and 44'. These hubs 42' and 44' are meshed in turn with splined lands 60', 58' on the axially movable adjustment sleeve 50, whereby axial displacement of the adjustment sleeve 50 rotates the valve leaves 38, 40 in the same general manner as previously described. However, as shown in FIG. 6, the splined lands 60', 58' are formed in common-handed directions with the same pitch, such that axial movement of the adjustment sleeve 50 is effective to rotationally adjust the position of the valve port 36 without altering the arcuate span of the valve port.

FIG. 7 shows a further modified form, similar to FIG. 6, but wherein splined lands 60'', 58'' on the adjustment sleeve 50 are formed in common-handed directions with different or non-uniform pitch. These lands 60'', 58'' are meshed with the associated hubs 42'', 44'' of the valve plate leaves 38, 40. In this version, axial displacement of the adjustment sleeve 50 results in rotational displacement of the valve port relative to crankshaft position as well as alteration of the arcuate span of the valve port.

The rotary valve assembly 12 thus provides for relatively simple yet effective adjustable valve timing in an internal combustion engine. In this regard, although the invention is shown and described with respect to a single cylinder of a two-stroke engine, it will be understood that the invention may be used with four-stroke engines and/or multicylinder engines. Moreover, it will be understood that the exemplary rotary valve assembly may be desirable for use as an exhaust valve in a combustion engine or other such fluid flow.

Further modifications and improvements of the present invention will be apparent to those persons skilled in the art. Accordingly, no limitation on the invention is intended by way of the foregoing description and accompanying drawings, except as set forth in the appended claims.

What is claimed is:

1. A rotary valve assembly for a combustion engine, comprising:

a rotary valve plate defined by a coaxially mounted pair of valve leaves cooperatively defining an arcuate open valve port;

means for mounting said valve plate on the engine to extend across an engine valve passage;

means for rotatably driving said valve plate in response to engine operation whereby said valve port is rotated across the engine valve passage to open the valve passage; and means for rotatably adjusting the position of said valve leaves relative to said driving means to adjust engine valve timing.

2. The rotary valve assembly of claim 1 wherein said means for rotatably driving said valve plate comprises a crankshaft for the engine.

3. The rotary valve assembly of claim 1 wherein said valve leaves include a respective pair of coaxially mounted hubs having helical splines formed thereon, and further wherein said means for rotatably displacing said valve leaves comprises a splined adjustment member engageable with said helical splines on said hubs.

4. The rotary valve assembly of claim 3 wherein said splined adjustment member comprises an adjustment sleeve including a pair of splined segments meshed respectively with said helical splines on said hub

5. The rotary valve assembly of claim 4 wherein said splined segments are formed in opposite-handed directions.

6. The rotary valve assembly of claim 4 wherein said splined segments are formed in common-handed directions.

7. The rotary vale assembly of claim 6 wherein said splined segments have a substantially uniform pitch.

8. The rotary valve assembly of claim 6 wherein said splined segments have a non-uniform pitch.

9. The rotary valve assembly of claim 4 wherein said adjustment sleeve is mounted on a rotatably driven engine shaft for rotation therewith, said adjustment sleeve being axially displaceable along said engine shaft through a short stroke in opposite directions for displacing said valve leaves.

10. The rotary valve assembly of claim 9 further including means for controllably displacing said adjustment sleeve axially within limits of said stroke in response to engine operating conditions.

11. The rotary valve assembly of claim 1 wherein the engine is a two-stroke engine.

12. The rotary valve assembly of claim 1 wherein the engine valve passage is an inlet passage for gas inflow to a combustion cylinder.

13. A rotary valve assembly for a combustion engine, comprising:

a rotary valve plate defined by a coaxially mounted pair of valve leaves cooperatively defining an arcuate open valve port, said valve leaves including axially overlapping trailing edge segments; and means for rotatably displacing said valve leaves relative to each other to adjust the arcuate span of said valve port.

14. The rotary valve assembly of claim 13 wherein said trailing edge segments of said valve leaves have an axial half-width thickness

15. The rotary assembly of claim 13 wherein said valve leaves include a respective pair of coaxially mounted hubs having helical splines formed thereon and further wherein said means for rotatably displacing said valve leaves comprises a splined adjustment member engageable with said helical splines on said hubs.

16. The rotary valve assembly of claim 15 wherein said splined adjustment member comprises an adjustment sleeve including a pair of splined segments formed respectively in opposite-handed directions and engaged respectively with said helical splines on said hubs.

17. A rotary valve assembly for a combustion engine, comprising:

a rotary valve plate defined by a pair of valve leaves each including a central hub, said hubs of said valve leaves respectively defining a pair of helical splines and being coaxially mounted to coaxially support said valve leaves, said valve leaves having axially overlapping trailing edges and arcuately separated leading edges defining an open arcuate valve port;

means for rotatably driving said valve plate in response to engine operation, with said valve plate extending across an engine valve passage whereby the valve passage is opened to gas flow each time the valve port is aligned therewith;

an adjustment sleeve driven rotatably by the engine and including a pair of lands formed respectively to define helical spline segments meshed respectively with said helical splines on said hubs; and means for axially displacing said adjustment sleeve within the limits of a defined stroke for adjusting the positions of said valve leaves to adjust engine valve timing.

18. The rotary valve assembly of claim 17 wherein said splined segments are formed in opposite-handed directions.

19. The rotary valve assembly of claim 17 wherein said splined segments are formed in common-handed directions.

* * * * *